US005111866A

United States Patent [19]

Prostko

[11] Patent Number: 5,111,866

[45] Date of Patent: May 12, 1992

[54] MOVABLE SHADE SYSTEM

[76] Inventor: Robert N. Prostko, 128 Quinnipiac Ave., North Haven, Conn. 06473

[21] Appl. No.: 710,576

[22] Filed: Jun. 5, 1991

[51] Int. Cl.[5] ..... E06B 3/94

[52] U.S. Cl. ..... 160/90; 160/84.1; 160/276; 160/281

[58] Field of Search ..... 160/84.1, 275, 276, 160/278, 281, 283, 288, 90

[56] References Cited

U.S. PATENT DOCUMENTS

| | | | |
|---|---|---|---|
| 501,674 | 7/1893 | Burrowes | 160/281 |
| 536,168 | 3/1895 | Burrowes | 160/281 |
| 1,071,475 | 8/1913 | Sorlie | 160/276 |
| 3,055,419 | 9/1962 | Rubin et al. | 160/84.1 |
| 4,665,964 | 5/1987 | Zommers | 160/84.1 |
| 4,694,877 | 9/1987 | Dunbar | 160/84.1 X |
| 4,867,220 | 9/1989 | Matsumoto et al. | 160/84.1 X |
| 4,880,045 | 11/1989 | Stahler | 160/84.1 |
| 4,932,704 | 6/1990 | Ament | 160/84.1 X |

*Primary Examiner*—David M. Purol
*Attorney, Agent, or Firm*—Bachman & LaPointe

[57] ABSTRACT

A shade covering a window movable from a first position to a second position and a plurality of shade carriers supporting the shade in spaced, parallel relationship to each other and disposed substantially perpendicular to tracks, with the carriers secured to and movable in the tracks. Slides are affixed to the carriers, seated in the tracks and movable therein, and a retaining device is provided between at least one of the slides and carriers releasably firmly holding the slide in any desired position in the tracks.

15 Claims, 3 Drawing Sheets

MOVABLE SHADE SYSTEM

BACKGROUND OF THE INVENTION

The present invention relates to a shade or sun screen system and more particularly to an improved type of movable sun shade assembly.

It is common practice to provide screens or shades for windows using tracks supported by the window frame, not only with respect to vertical flat windows but also curvilinear, multi-angular or horizontal windows used in offices, homes or greenhouses. Frequently, a plurality of shades are provided and it is essential that a simple and convenient system be developed for raising and lowering same. Moreover, it is desirable that the system be free-moving, not involve the use of unsightly strings and enable independent movement of separate shades without expensive motorized units.

Accordingly, it is a principal object of the present invention to provide an improved movable shade system which is easy to use, versatile and relatively inexpensive.

It is a further object of the present invention to provide a movable shade system as aforesaid which enables free-movement of shades and independent movement of separate shades.

Further objects and advantages of the present invention will appear hereinafter.

SUMMARY OF THE INVENTION

In accordance with the present invention it has now been found that the foregoing objects and advantages may be readily obtained.

The present invention provides an improved movable shade system in combination with a window, a frame supporting the window and at least two substantially parallel spaced tracks supported by the frame, which comprises: a shade covering said window movable from a first position to a second position; a plurality of shade carriers supporting said shade in spaced parallel relationship to each other and disposed substantially perpendicular to said tracks, said carriers being secured to and movable in said spaced tracks to move the shade from said first position to said second position; sliding means affixed to said carriers seated in said tracks and movable therein; and retaining means on at least one of said sliding means preferably between said carriers and tracks, releasably firmly holding at least one sliding means in any desired position in said tracks. In an advantageous embodiment, the two lowermost of the shade carriers include a retaining means on opposite sides thereof, and the remaining carriers are freely slidable in the tracks.

The shade carriers are generally hollow tubular members having end portions thereof spaced inwardly from the tracks and include plastic bars seated in the end portions of the tubular members and extending outwardly therefrom and terminating in an enlarged head or guide means seated in the tracks.

In a preferred embodiment, the retaining means includes a holding member provided adjacent the enlarged head and seated external to said track, wherein a portion of the track is positioned between the holding member and enlarged head. The retaining means desirably includes spring means between the holding member and carrier urging the holding member into engagement with said track.

Further features and advantages of the present invention will appear hereinbelow.

BRIEF DESCRIPTION OF THE DRAWINGS

The foregoing will be more readily apparent when considered in conjunction with the following illustrative drawings, wherein.

DETAILED DESCRIPTION

Figure 1:
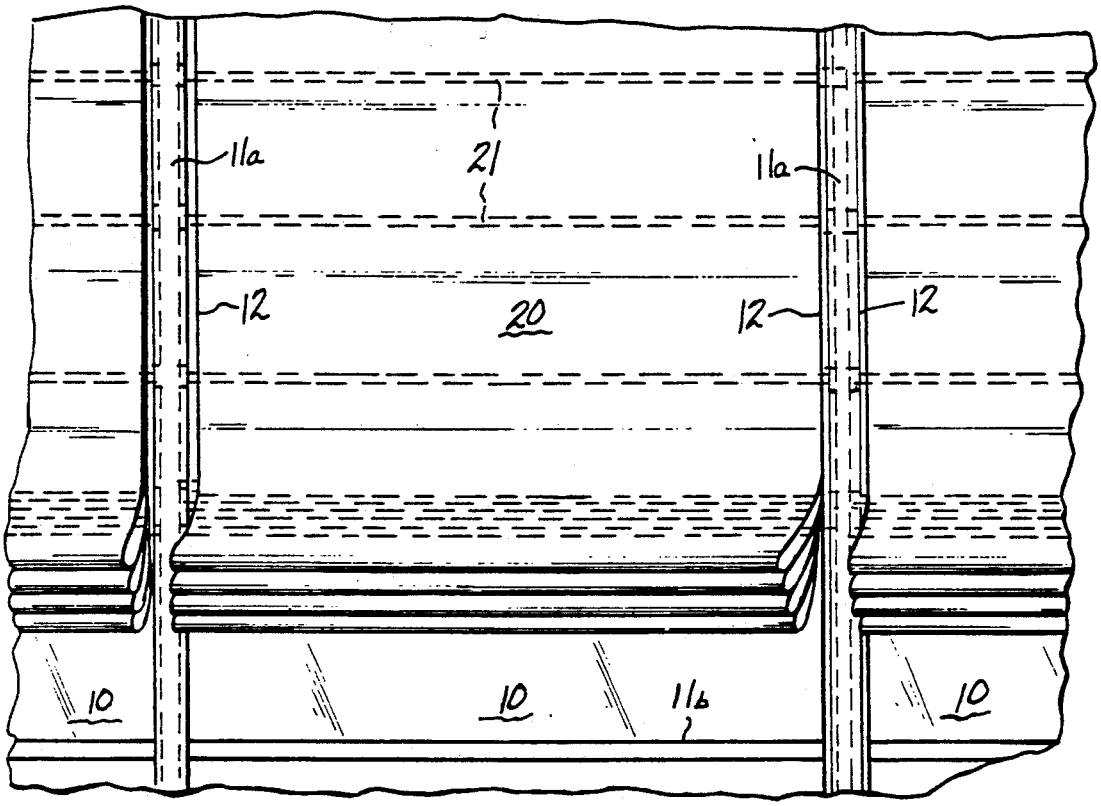
FIG. 1 is a front elevation of a first preferred embodiment of the present invention.
Figure 2:
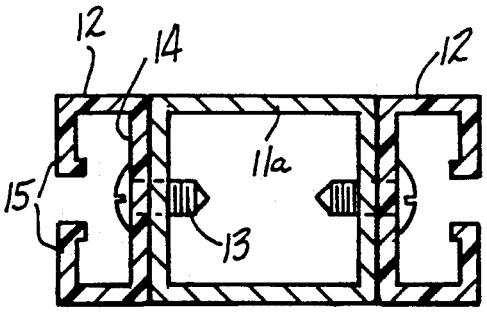
FIG. 2 is an enlarged sectional view of a section of frame and tracks.

FIG. 1 shows a first preferred embodiment of the movable sun shade system of the present invention. FIG. 1 shows a plurality of windows 10 supported by frame members or mullions 11*a* and 11*b*. As shown in FIG. 1, the frame members 11*a* extend longitudinally or vertically and frame members 11*b* extend horizontally or laterally. The number of horizontal frame members 11*b* depends on the size of windows 10. At least two parallel, spaced tracks 12 (which may be rectangular or round) are carried by frame members 11*a* generally extending inwardly thereof. Tracks 12 include an internal space 14 formed by track arms 15. Naturally, an end frame member carries only a single track. Tracks 12 may be formed directly on the frame members or may be separate tracks attached thereto as shown in FIG. 2 as by screws 13. The frame members are generally formed of metal, as aluminum, but may also be formed of other materials as wood or plastic. The tracks may be formed of plastic or metal. FIG. 1 shows a plurality of flat, horizontally disposed windows 10, but it should be understood that the present invention may be readily used with vertically disposed or curvilinear type windows. Also, instead of a plurality of side-by-side windows, the present invention may readily be used on a single window.

Movable shades 20 cover each window 10 movable generally from a first lowered position covering the window to a second raised or open position. FIG. 1 shows shade 20 in a partly open position. The present invention contemplates movement from any first position to any second position, for example, movement from a raised to a lowered position, movement to partially raise or lower, or axial or lateral movement. Shades 20 are supported by a plurality of shade carriers or rods 21 shown in phantom in FIG. 1 and shown more clearly in a preferred embodiment of FIG. 3. The shade carriers or rods 21 may be situated within the shade as shown in FIG. 1 in pockets or the like in spaced, parallel relationship to each other and disposed substantially perpendicular to tracks 12. The shade carriers and hence the shades are secured to and movable in the spaced tracks to move the shade to any desired position.

Figure 3:
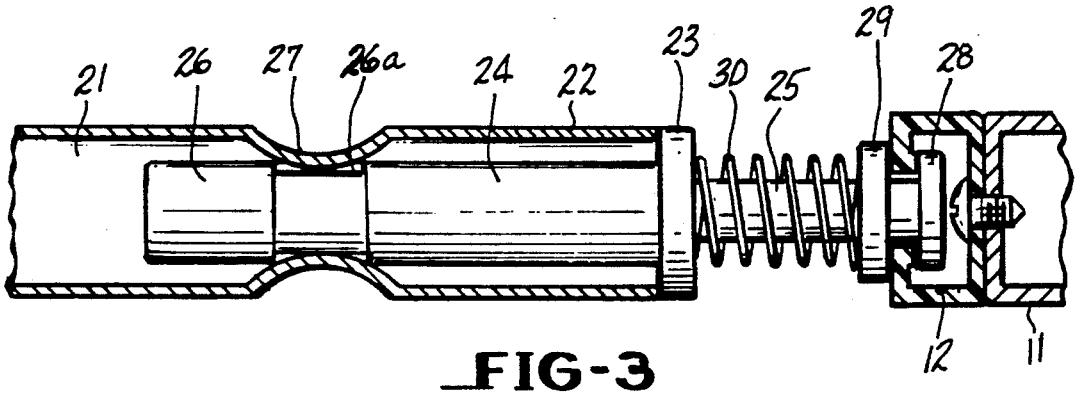
FIG. 3 is an enlarged fragmentary sectional view of a preferred embodiment of a shade carrier-track assembly.

In accordance with the preferred embodiment of FIG. 3, shade carrier 21 comprises a hollow metal, plastic or fiberglass tube or rod, preferably aluminum, having end portions thereof 22 and which may if desired have an end cap 23. End portions 22 of rods 21 and also shades 20 are spaced inwardly from tracks 12 in order to provide sliding freedom for the shades. Sliding means 24 are affixed to carriers 21 and are seated in tracks 12 and movable therein.

In FIG. 3, sliding means 24 comprises a plastic or metal bar having a leading end 25 and a trailing end 26. The sliding means is inserted in hollow tube 21 and fixed therein by crimping end portion 22 at crimped section 27 around trailing end 26, preferably to allow some freedom of movement for the sliding means in the shade carrier. Thus, trailing end 26 may include a recessed portion **26*a* to receive crimped section 27. Leading end 25 extends outwardly from end portion 22 and terminates in an enlarged head portion or guide means 28 seated in track 12 and slidable therein. Enlarged portion 28 may be readily inserted in track space 14 by spreading track arms 15 if the material of the tracks is sufficiently flexible to permit spreading, or by simply inserting the enlarged portion in an open track end. The flexibility of track 12, which may preferably be formed of a strong plastic as polycarbonate, causes the track arms to snap back without deformation thereof. Movable holding member 29 is provided on leading end 25 adjacent enlarged head 28 and seated external to track 12, with track arms 15 being positioned between holding member 29 and head 28. Spring 30 on bar 24 seated between end cap 23 and holding member 29 urges the holding member into engagement with track arms 15 as shown in FIG. 3. The holding member is preferably freely movable on the sliding means or bar 24 so that it is readily urged into engagement with track arms 15. Head 28 also engages track 12 on the inside thereof so that carriers 21 and hence the shades are held in position. Movement up or down can be easily achieved by simply grasping the shade or a handle and moving in the desired direction since the tension applied by spring 30 and holding member 29** will not prevent such movement. Thus, the retaining means holds the carrier firmly in position but releasably in position so that the carrier may readily be moved in the tracks. If the shade is out of manual reach it can easily be moved by a pole.

It can be readily appreciated that if desired the sliding means can be affixed to the outside of a rod, which may be a solid rod if desired. Thus, the rods can have any convenient shape and configuration as circular, oval, flat, hollow or solid.

Figure 4:
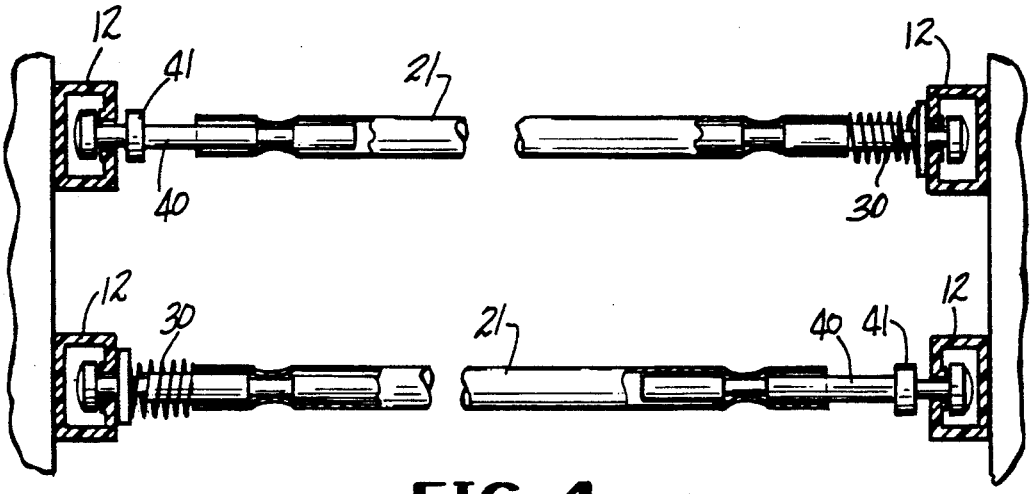
FIG. 4 is a front elevation, partly broken away, of the two lowermost shade carriers.

FIG. 4 shows a preferred embodiment of the two lowermost shade carriers 21. As shown in FIG. 4, the left side of one carrier includes spring 30 applying tension as described with respect to FIG. 3 and the right side of the other carrier includes spring 30 applying tension as described with respect to FIG. 3. The opposite side of each carrier includes a modified sliding means 40 crimped to rods 21 as with FIG. 3, but having a fixed double-headed end portion 41 which freely slides in tracks 12. This alternate tensioned arrangement permits free movement of the shades with a lessened tendency to bind. Naturally, if desired retaining means can be applied to both ends and to as many rods as convenient. Also, of course, the tension can be adjusted to meet desired needs, as for example by varying the size of the spring.

Figure 5:
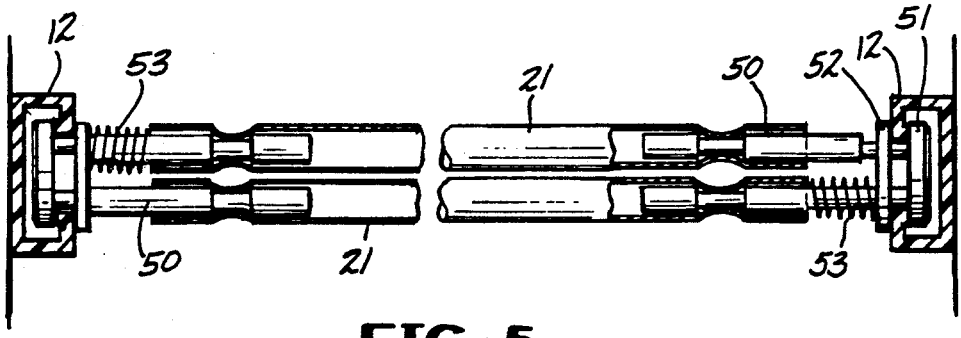
FIG. 5 is an alternate embodiment showing two shade carriers secured to and movable in a single track.

FIG. 5 shows an alternate embodiment where two shade carriers 21 are secured to and movable in a single track 12 on each side thereof. A modified sliding means 50 is provided attached to each rod 21 similar to sliding means 24 except that both sliding means carry a single head portion 51 seated in tracks 12 and a single holding member 52 seated externally of tracks 12, with one of the sliding means 50 carrying a spring 53. Desirably, the spring 53 is placed in alternating fashion from side to side as shown in FIG. 5 with one side having the spring affixed on the uppermost sliding means and the other side on the lowermost. This double rod arrangement is advantageous for heavier shades. The alternating spring arrangement has a lessened tendency to bind. As a further alternative one can utilize three shade carriers movable in a single track with the central carrier including a retaining means on both sides thereof and the other carriers utilizing a modified slide means similar for example to slide means 40 with fixed double headed end portion 41.

Figure 6:
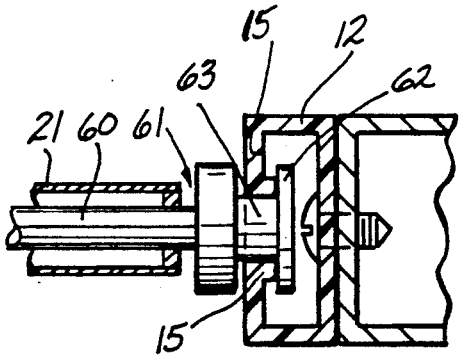
FIG. 6 is an alternate embodiment showing the sliding means including an enlarged neck portion which places the track arms under tension.

FIG. 6 shows an alternate embodiment where modified sliding means 60 is received in rod 21 in the same manner as in FIG. 3. Leading end 61 of sliding means 60 carries an enlarged end portion or guide means 62 seated in track 12 similar to guide means 28. However, sliding means 60 includes an enlarged neck portion 63 adjacent guide means 62 and seated in track arms 15 and in contacting relationship therewith placing the track arms under tension. This tensioned holding serves the function of a retaining means and permits the sliding means to releasably firmly hold the carriers and shades in any desired position in the same manner as described hereinabove. It also permits the easy movement of the carriers and shade from position to position.

Figure 7:
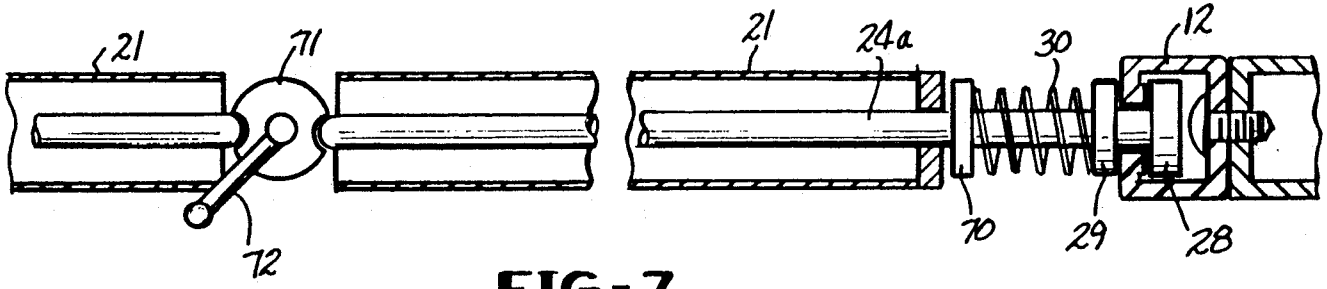
FIG. 7 is a further embodiment showing a hand actuated locking mechanism for locking the retaining means in place.

FIG. 7 shows a further embodiment for locking the retaining means in place. In accordance with the embodiment of FIG. 7, rod 21 is provided with sliding means **24*a* which similar to sliding means 24 has guide or enlarged end portion 28 seated in track 12 and holding member 29 tensioned by spring 30. However, rod 24*a* is provided with tension or shoulder member 70 which compresses spring 30 against holding member 29 by cam 71. Rod 24*a* is movable by cam 71 and handle 72 to move rod 24*a* and tension member 70 towards track 12 or to release tension by permitting rod 24*a* to move away from track 12 as shown in FIG. 7. In the released position shown in FIG. 7 the tension is released and the shade carriers are free to move. In the tensioned position, the shade carrier and shade is locked in position. The rod is preferably movable in both directions as shown in FIG. 7 and may be easily actuated by a handle applied external to the shade for convenient movement. The device shown in FIG. 7** is illustrative and any convenient means may be used for locking and unlocking the retaining means in place.

Figure 8:
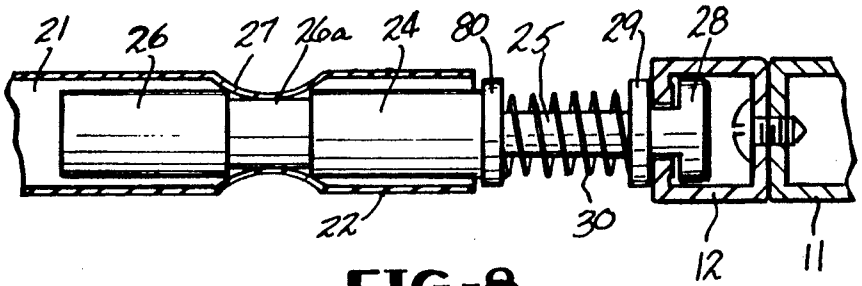
FIGS. 8–9 show further embodiments of the present invention.

The embodiment of FIG. 8 is similar to the embodiment of FIG. 3 wherein shade carrier or rod 21 is open at the end portion 22 thereof, i.e., no end cap 23 is employed. Also, sliding means 24 is provided with a fixed tension or shoulder member 80 on the leading end 25 thereof which tensions movable holding member 29 and thereby releasably firmly holds sliding means 24 in any desired position as aforesaid. Shoulder member 80 is fixed to sliding means 24 so that any desired degree of tension can be provided.

Figure 9:
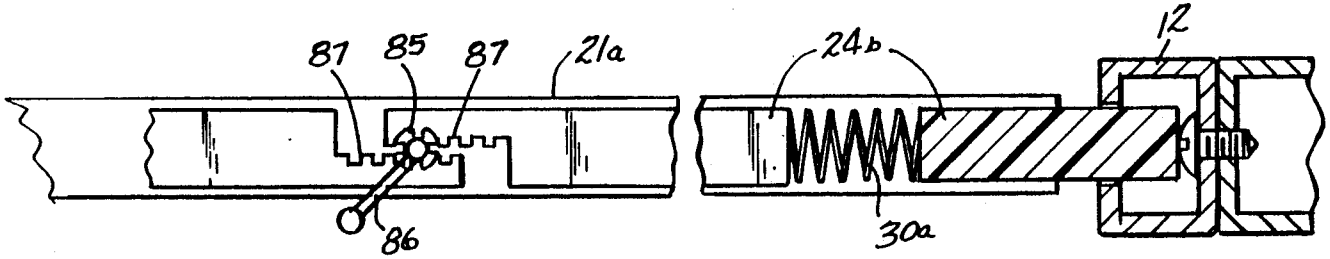

The embodiment of FIG. 9 is similar to the embodiment of FIG. 7 using a plate-like sliding means 24*b* movable by gear wheel 85 and handle 86 engaging gear teeth 87 permitting sliding means 24*b* to move towards and away from track 12. In the engaged position shown in FIG. 9, sliding means 24*b* is locked in position in track 12. Movement of handle 86 and gear wheel 85 moves gear teeth 87 and sliding means 24*b* away from track 12 and permits the shade carrier 21*a* and hence the shade to freely move. In this case, the shade carrier is rectangular to accommodate the plate-like sliding means. Naturally, however, any convenient shape can be used. Spring means 30*a* may be used engaging the sliding means in order to accommodate a situation where the tracks are not entirely parallel. If desired, the end portion of sliding means 24*b* can be formed of a flexible material as rubber or plastic to facilitate smooth movement and the central portion of metal for convenient gearing. Also, as can be seen from FIG. 9, the end portion of sliding means 24*b* need not be enlarged. As can be seen from FIG. 9, the end portion of sliding means 24*b* engages the inside portion of track 12 or the screw head if a screw is used or if a screw head appears at that location in the locked position.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An improved movable shade system in combination with a window, a frame supporting said window and at least two substantially parallel spaced tracks supported by said frame, which comprises: a shade covering said window movable from a first position to a second position; a plurality of shade carriers supporting said shade in spaced parallel relationship to each other and disposed substantially perpendicular to said tracks, said carriers being secured to and movable in said tracks to move the shade from said first position to said second position; sliding means affixed to said carriers and terminating in a guide means seated in said tracks and movable therein; and retaining means on at least one of said sliding means including a holding member adjacent said guide means and seated external to said track, wherein a portion of the track is positioned between said holding member and guide means, said retaining means releasably firmly holding at least one sliding means in any desired position in said tracks, wherein said holding member is freely movable on said sliding means towards and away from said guide means and including means to urge said holding member into engagement with said track.

2. A shade system according to claim 1 wherein said retaining means is between said carriers and said tracks.

3. A shade system according to claim 2 wherein the two lowermost shade carriers include one of said retaining means on opposite sides thereof.

4. A shade system according to claim 2 wherein said shade carriers are hollow tubular members having end portions spaced inwardly from said tracks and, said sliding means including bars seated in the end portions of said tubular members and extending outwardly therefrom and terminating in a guide means seated in said tracks.

5. A shade system according to claim 4 wherein said retaining means includes spring means between said holding member and carrier urging said holding member into engagement with said tracks.

6. A shade system according to claim 5 including a shoulder member fixed to said sliding means engaging said spring means and urging said spring means into engagement with said holding member.

7. A shade system according to claim 5 wherein said holding member is a ring-like member freely movable on said bar and contacting said spring means and urged into engagement with said track by said spring means.

8. A shade system according to claim 4 wherein said track includes track arms and said bar includes an enlarged neck portion adjacent said guide means and seated in said track arms placing said track arms under tension.

9. A shade system according to claim 4 wherein the sliding means includes a trailing end seated in the end portion of said tubular member with a recessed portion thereof, and a crimped section of the tubular member received in said recessed portion.

10. A shade system according to claim 4 wherein the guide means is fixed on said bar and engages the tracks on the inside thereof.

11. A shade system according to claim 1 including a plurality of side-by-side windows and frames.

12. A shade system according to claim 1 including locking means for locking and unlocking the retaining means in place.

13. A shade system according to claim 12 including a handle for actuating the locking means.

14. An improved movable shade system in combination with a window, a frame supporting said window and at least two substantially parallel spaced tracks supported by said frame, which comprises: a shade covering said window movable from a first position to a second position; a plurality of shade carriers comprising hollow tubular members having end portions spaced inwardly from said tracks, said carriers supporting said shade in spaced parallel relationship to each other and disposed substantially perpendicular to said tracks, said carriers being secured to and movable in said tracks to move the shade from said first position to said second position; sliding means including bars seated in the end portions of said tubular members and extending outwardly therefrom and terminating in a guide means seated in said tracks and movable therein; and retaining means between said carriers and said tracks on at least one of said sliding means releasably firmly holding at least one sliding means and any desired position in said tracks; wherein said retaining means includes a holding member adjacent said guide means and seated external to said track, wherein a portion of the track is positioned between said holding member and guide means; and wherein said retaining means includes spring means between said holding member and carrier urging said holding member into engagement with said tracks; and including two shade carriers in adjacent relationship with a single holding member and guide means seated thereon on each end thereof.

15. A shade system according to claim 14 wherein each end of said two carriers includes a single spring means.

* * * * *